United States Patent [19]

Dolhaine

[11] 4,443,972

[45] Apr. 24, 1984

[54] OVERHEAD TILTING DOOR ASSEMBLY

[76] Inventor: Alfred W. J. Dolhaine, 467 Cedarpark Dr. SW., Calgary, Alberta, Canada

[21] Appl. No.: 251,241

[22] Filed: Apr. 6, 1981

[51] Int. Cl.[3] ..... E05F 11/00

[52] U.S. Cl. ..... 49/200; 49/197

[58] Field of Search ..... 42/197, 199, 200

[56] References Cited

U.S. PATENT DOCUMENTS 1,792,119 2/1931 Peelle ..... 49/199

FOREIGN PATENT DOCUMENTS 1354759 2/1964 France ..... 49/197
458110 8/1968 Switzerland ..... 49/200
734200 8/1955 United Kingdom ..... 49/200

*Primary Examiner*—Kenneth Downey
*Attorney, Agent, or Firm*—Max L. Wymore

[57] ABSTRACT

An overhead tilting door assembly is provided, particularly for use in large buildings. The door assembly includes a door member having a quadrant member attached to each of its upper corners. Generally horizontal support members are provided on either side of the door member extending rearwardly therefrom. Each quadrant member is rolled along a support member to tilt the door between open and closed positions. A drive means is pivotally attached to a quadrant member for tilting the door member and for locking the door member against movement, unless being tilted by the drive means. The assembly also includes anti-skid means between the quadrant members and the support members to force the quadrant members to roll and not skid along the support members.

5 Claims, 13 Drawing Figures

6
7
5
B
A
12
11
2
13
4
1
3'
5
12
3
11
13

6
7
5
B
A
12
11
2
13
4
1
3'
5
12
3
11
13

6
7
5
12
A
11
13
2
4
1
3'
5
12
11
13
3

6
12
7
5
11
13
A
2
4
1
3'
5
13
3

18
54'
61'
55'
57'
58'
59'
48'
62'
51'
45'
16'
47'
68'
19
65'
14'
38'
64'
67'
6
7
30
5
28
29
12
11
20
24'
30
30
13
3'

OVERHEAD TILTING DOOR ASSEMBLY

BACKGROUND OF THE INVENTION

The present invention relates to an overhead tilting door assembly for use in buildings, particularly in large buildings.

One of the most common types of door assemblies used in large buildings includes horizontally sliding doors. The doors are supported by the floor of the building and slide in tracks along the floor. Problems arise with these doors as the tracks can accumulate ice and mud or heave to become misaligned. Consequently, these doors are often difficult to open and close. Further, these doors require storage space on either side of the opening to accommodate the door leaves in the door open position. This storage space cuts down on the width of an opening that can be provided for a given limited area of space or land.

Another type of door assembly being built in large buildings includes a fabric roll-up type door. This door assembly comprises a wide expanse of fabric suspended from the header of a building. The door is rolled up from its lower edge around a heavy pipe secured thereto. While this type of door assembly eliminates the above-mentioned problems of the sliding doors, it has other disadvantages. The header, from which the door is suspended, must be strong to withstand the tension of the fabric caused by the wind, and to prevent inward movement of the door with the wind. It is usually disadvantageous to have a large header, since it extends downwardly into the door opening and thereby decreases the height of the useable opening for a given building height. Further, the space between the underside of the header and the roof, termed the header space, is wasted. Often building heights are critically controlled, particularly at airports, so it is desirable to minimize this header space. This type of door also provides minimal insulation to a building. In harsh climates this can be a problem. Further, this type of door usually cannot be opened in high winds without damaging either the door or the header or the heavy pipe.

A number of patents have been issued for overhead tilting door assemblies wherein the door is attached to a quadrant and is tilted by forcing the quadrant to roll along horizontal supports beside the door. Exemplary of these patents are Belgian Pat. Nos. 649,849 and 565,882, British Pat. No. 414,978, German Pat. No. 869,686 and French Pat. No. 1,354,759. All of these patented devices have one common major disadvantage; they include a counterweight on the quadrants to counterbalance the weight of the door. In a large building, the weight of the door is large, and the counterweight accordingly becomes large. Accommodating such a large counterweight can increase the header space and therefore the height of the building. Also, the weight itself, and the reinforced support means required to support the weight, add to the costs of the building. Furthermore and perhaps most importantly, it is impossible, with a fixed counterweight, to balance a door against the unpredictable force of the wind. Against large doors, this variable wind force can become very large, and therefore must be taken into consideration.

SUMMARY OF THE INVENTION

In accordance with the present invention, an overhead tilting door assembly is provided. The door assembly is particularly engineered for use in large buildings, for example in airplane hangars, however it may of course find application in smaller buildings.

The door assembly includes a non-counterweighted door and quadrant assembly comprising a door member having a guadrant member attached to each of its upper corners. The door assembly further includes generally horizontal . fixed support members on either side of the door member extending generally perpendicularly and rearwardly from the door members. Each quadrant member is rolled along a support member to tilt the door between open and closed positions. The door assembly also includes a drive means pivotally attached to the door and quadrant assembly, and most preferably to at least one of the quadrant members, for tilting the door member and for locking the door member against tilting movement, unless being tilted by the drive means. The drive means provides all of the force required to tilt the door member. The assembly also includes anti-skid means located between the arced edges of the quadrant members and the support members. The anti-skid means interconnect the fixed support members and the movable quadrant members and are operative to force the quadrant members to roll along the support members as the door member is being tilted.

By locking the quadrant members against movement with the drive means, the door member is locked against movement from vertlcal or horizontal forces, such as gravity and the wind, acting on the door member. Further, the present invention eliminates the need for a large and expensive counterweight above the door member. This feature can be used to minimize the height of the header space included above the door member.

In a preferred aspect of the invention the door member is configured with an upper portion of increased thickness relative to the lower portion for providing transverse rigidity to the door member. This feature is included in a door member having a wide span to reinforce the door member against sagging both from the weight of the door member when the door is open and from the wind force acting on the door in any position. The upper portion is sized to clear the header as the door member is tilted. Thus, in the door open position, it is the lower portion of the door member, having a decreased thickness, which extends below the header into the door opening. This preferred feature can be used to maximize the height of the opening available in the door open position.

The drive means preferably comprises an internally-threaded, rotatably driven nut member supported rearwardly from the quadrant member; a threaded rod arranged parallel to the support member, one end of the rod being pivotally connected to the apex of the quadrant member, the other end of the rod being threadably received in the nut member, the threads of the rod and the nut member being self-locking such that the threaded rod is locked against movement through the nut member unless the nut member is being rotatably driven, whereby rotation of the nut member moves the rod through the nut member causing the quadrant member to roll along the support member to tilt the door member.

The anti-skid means preferably comprise a first cable, stretched along the arced edge of the quadrant member, one end of which is connected to the support member approximately at the point of contact between the quadrant member and the support member in the door closed position, the opposite end of which is connected to the quadrant member approximately at the point of contact between the quadrant member and the support member in the door open position; and a second cable stretched along the arced edge, one end of which is connected to the quadrant member approximately at the point of contact between the quadrant member and the support member in the door closed position, the opposite end of which is connected to the support member approximatley at the point of contact between the quadrant member and the support member in the door open position.

Broadly stated, the invention provides an overhead tilting door assembly comprising a door and quadrant assembly including a door member and a pair of quadrant members, each of the quadrant members being connected to and extending rearwardly from an upper corner of the door member, and each quadrant member having an arced edge; a pair of generally horizontal support members, one on either side of the door member, extending generally rearwardly from the door member, each of the quadrant members being supported along the arced edge by the support member such that the quadrant members can roll along the support members to tilt the door member between a generally vertical closed position and a generally horizontal open position; drive means connected to the door and quadrant assembly for tilting the door member and for locking the door member against tilting movement unless being tilted by the drive means; and anti-skid means between the arced edges of the quadrant members and the support members for forcing the quadrant members to roll along the support members as the door is being tilted.

DESCRIPTION OF THE PREFERRED EMBODIMENT

Figure 1A:
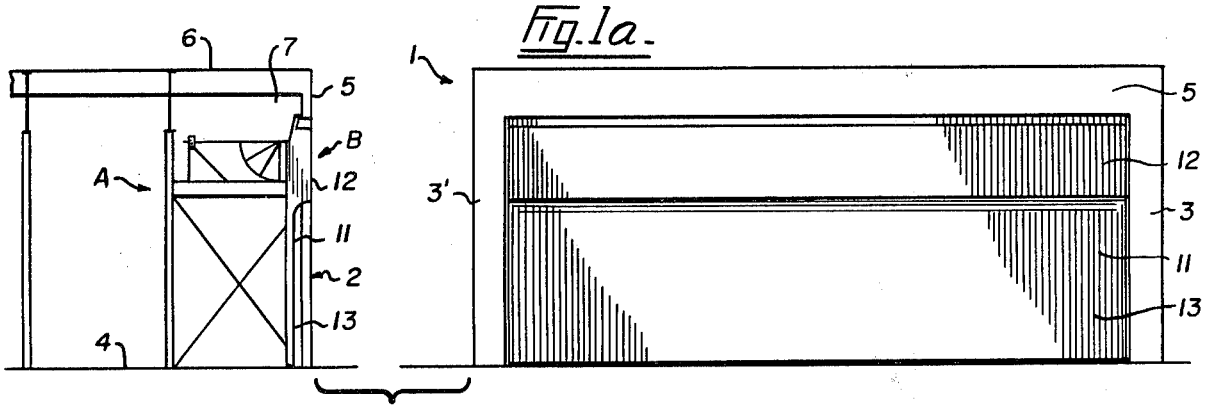
FIGS. 1*a*–1*d* are a series of schematic front and side views of the preferred embodiment of the door assembly as the door member is tilted from fully closed to fully open positions. The door member is configured such that the narrower lower door portion is recessed relative to the thicker upper door portion.
Figure 1B:
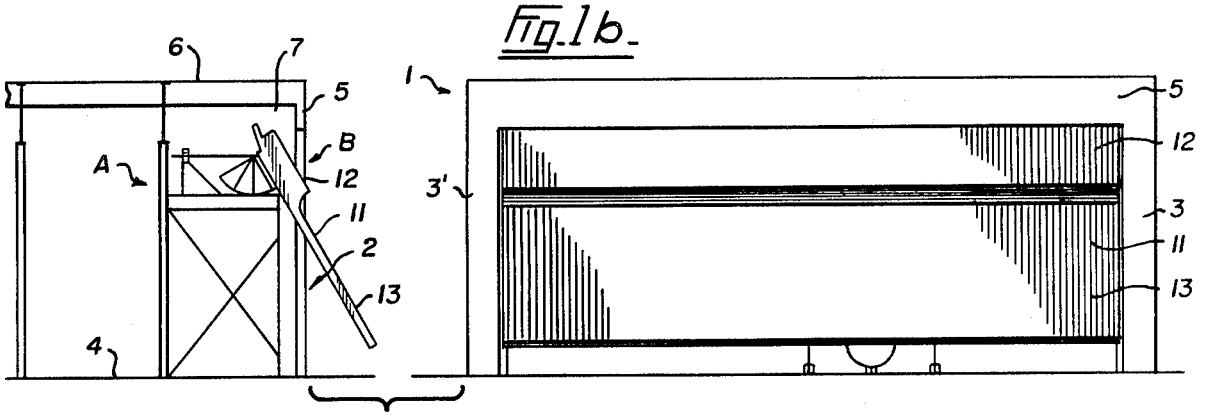
Figure 1C:
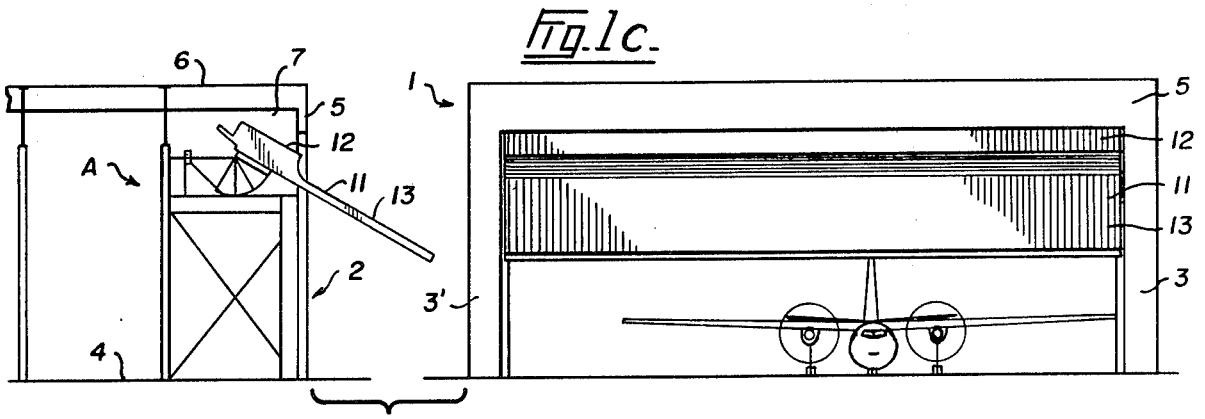

The present invention is shown schematically in FIG. 1. The door assembly A is included in an airplane hangar 1. Of course the door assembly A can be provided in any size of building, however, as will become apparent, the door assembly A has been engineered for use in large buildings which require large door spans.

The hangar 1 includes an opening 2, framed by partial front walls 3, 3', the floor 4, and a header 5. The header 5 extends downwardly into the opening 2 from the hangar roof 6. The space below the roof 6 and behind the header 5 is termed the header space 7. It is the height of this header space 7 which the present invention seeks to minimize.

Figure 1D:
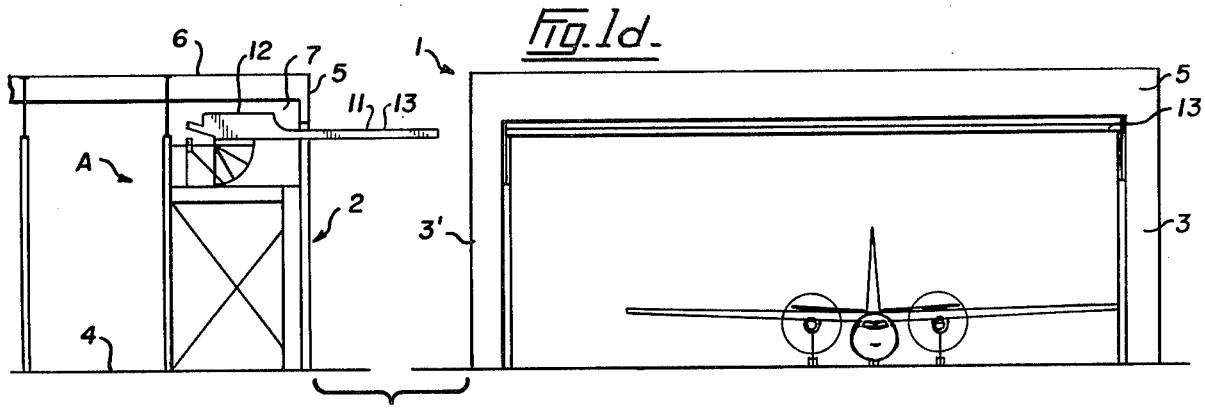
Figure 2A:
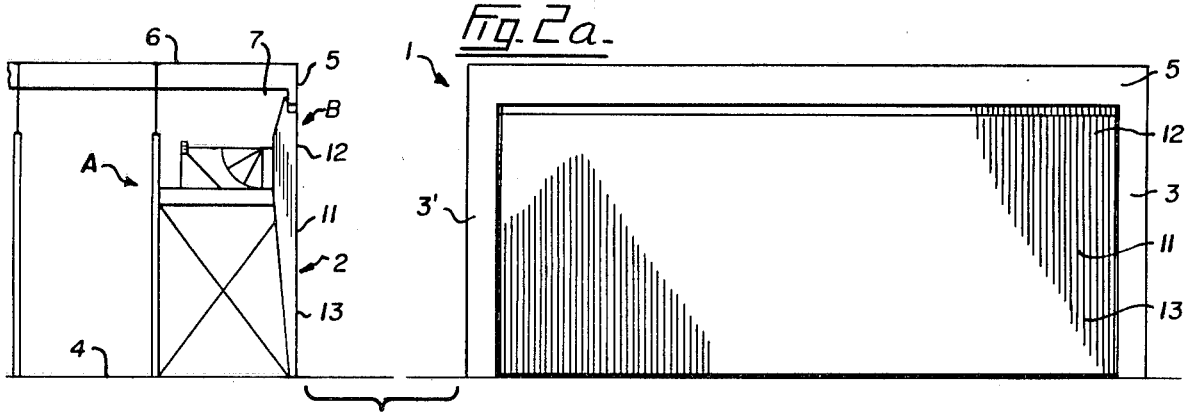
FIGS. 2*a*–2*d* are a series of schematic front and side views of a second embodiment of the door assembly as the door member is tilted from fully closed to fully open positions. The door member is tapered from the thicker upper door portion to the narrower lower door portions.
Figure 2B:
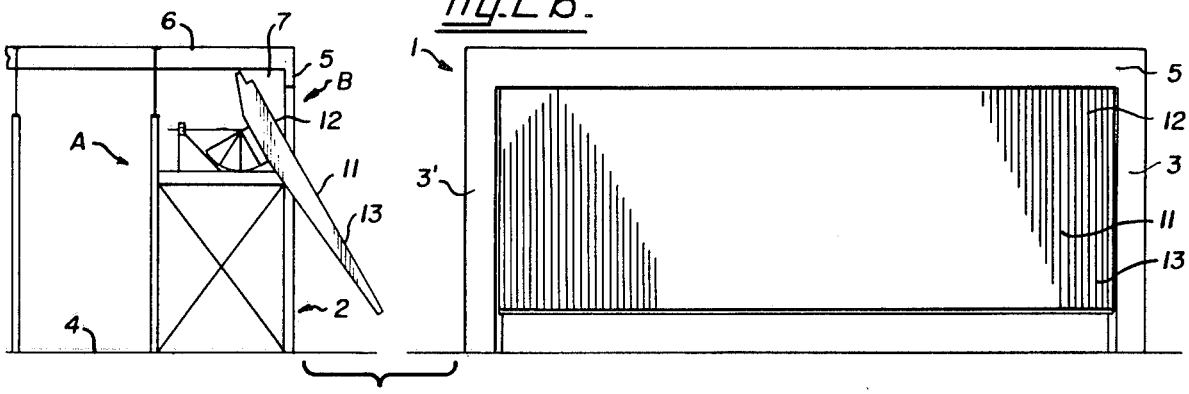
Figure 2C:
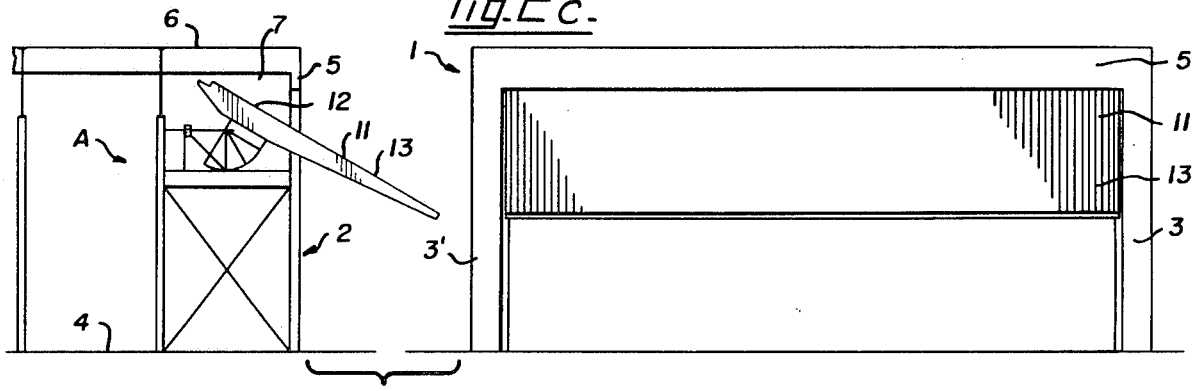
Figure 2D:
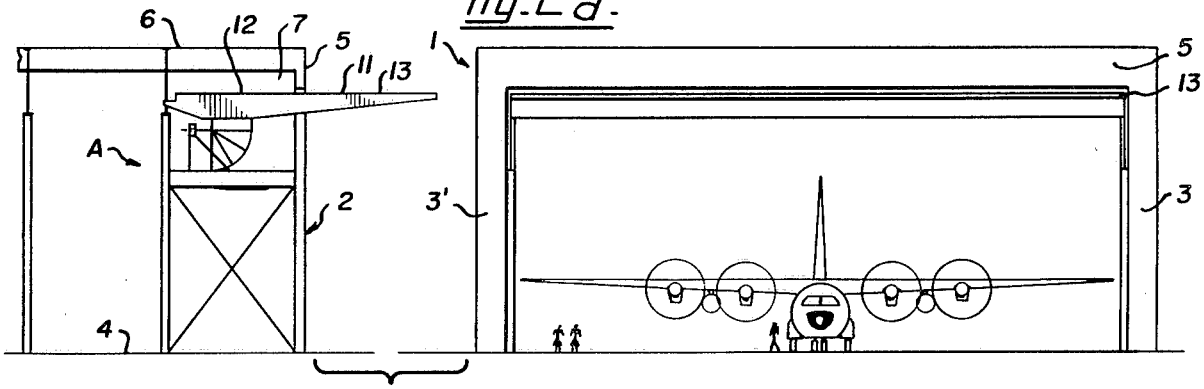
Figure 3:
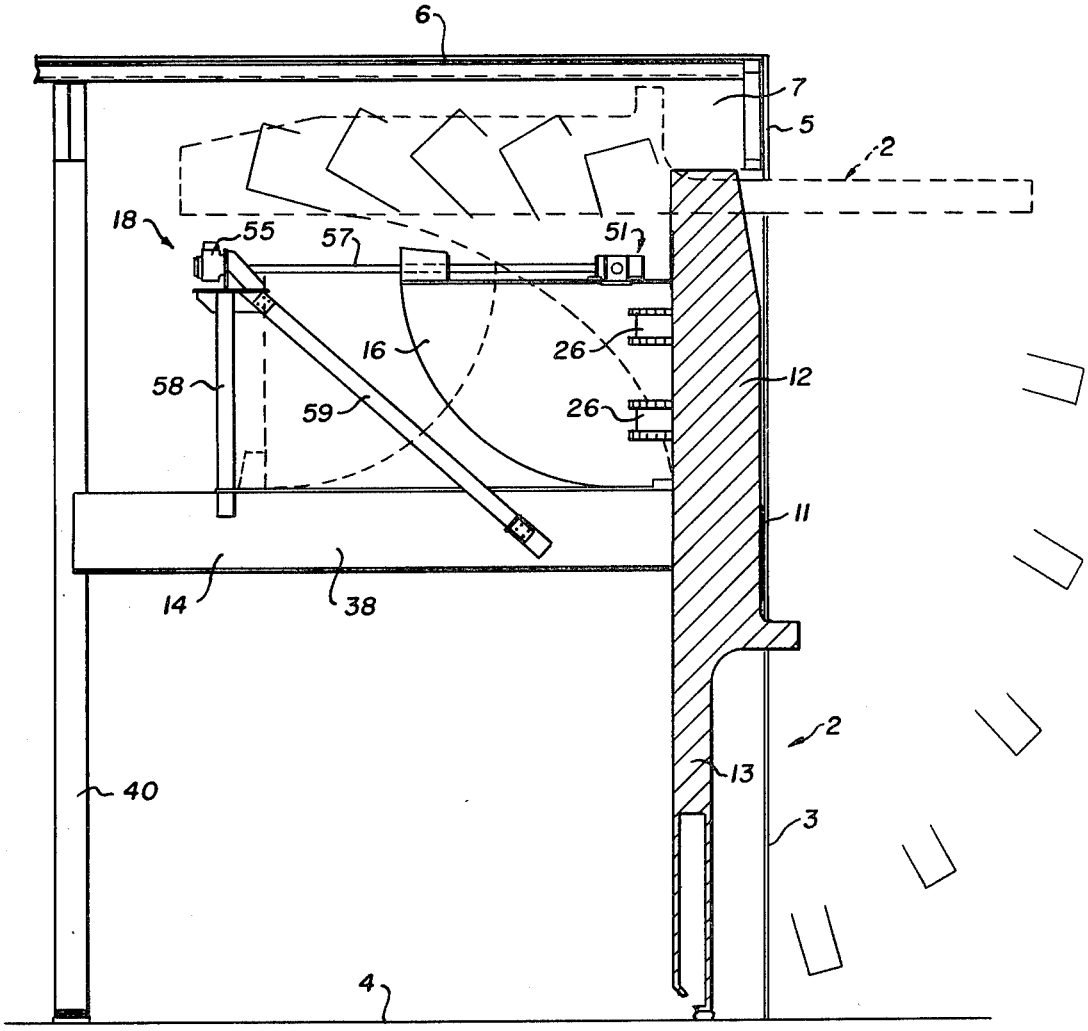
FIG. 3 is a side schematic view of the door assembly showing the space occupied by the door member as it is tilted, the upper door portion being sized to clear the header.
Figure 4:
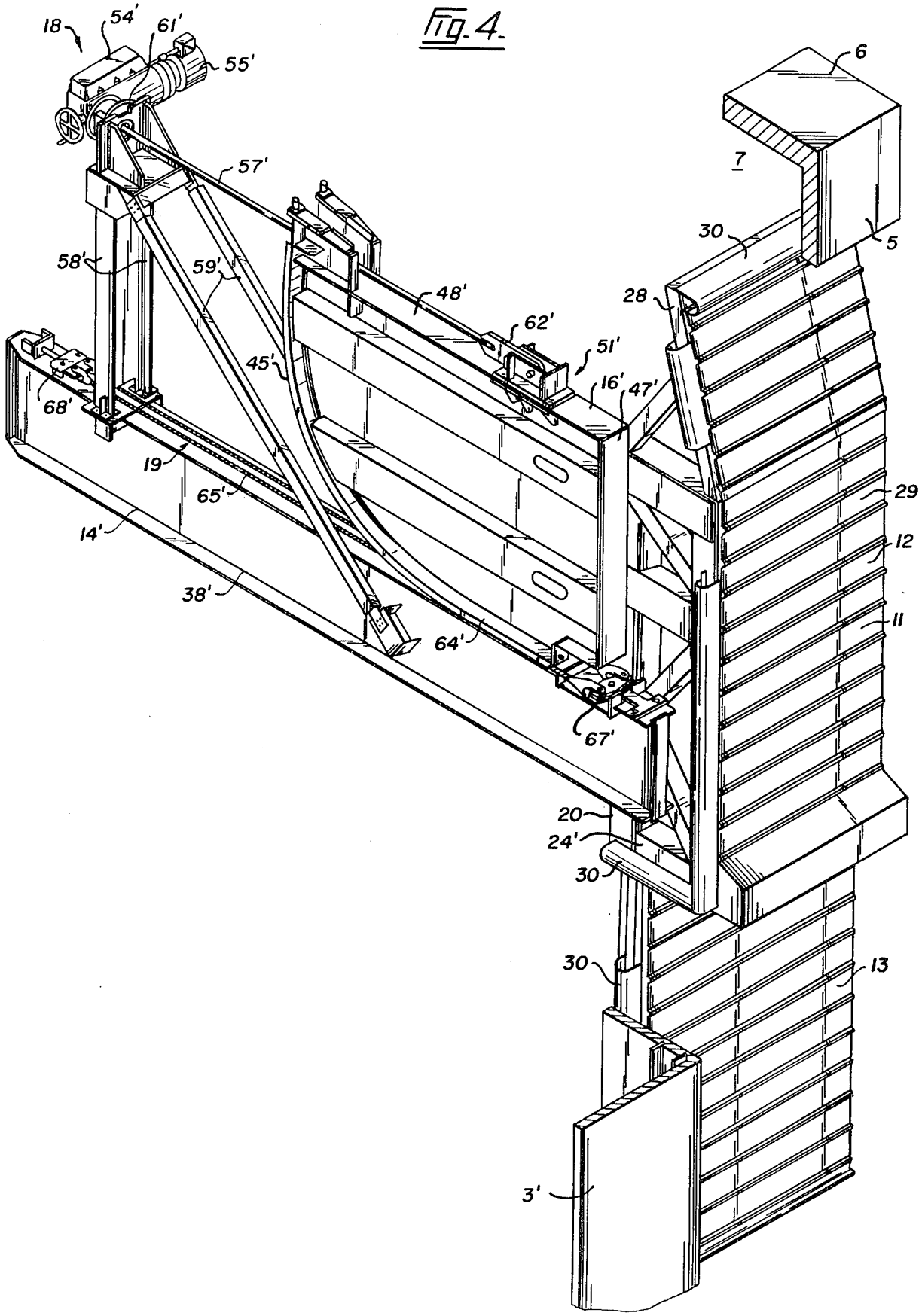
FIG. 4 is a front perspective view of the door assembly with the building walls and header partially cutaway.
Figure 5:
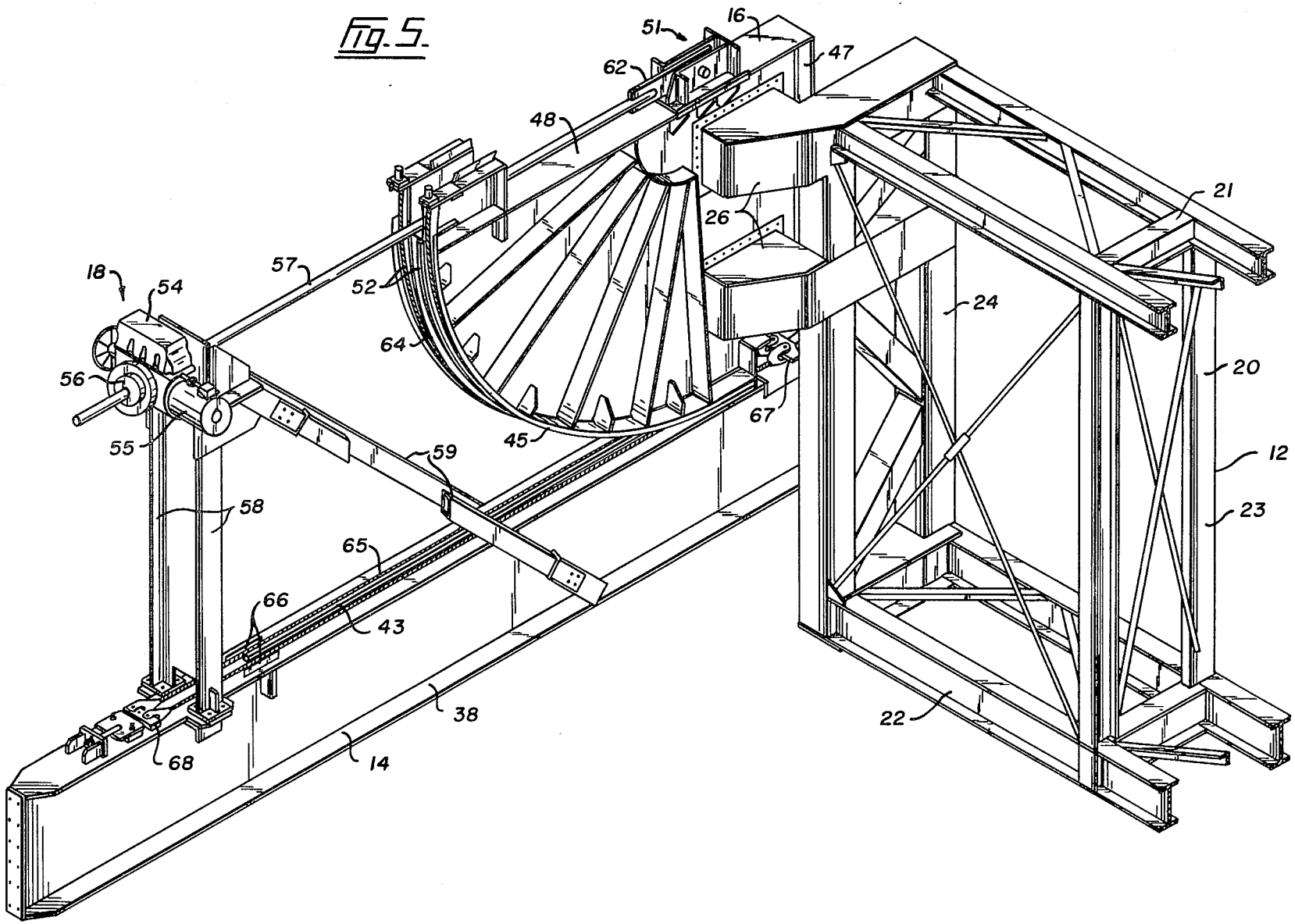
FIG. 5 is a rear perspective view of the door assembly with the outer cladding removed from the door member.

The door assembly A includes a door and quadrant assembly B comprising a door member 11 sized to close the opening 2 and two quadrant members 16, 16' attached to the door member 11. The door member 11 comprises adjoining upper and lower door portions 12, 13 respectively. Two generally horizontal support members 14, 14' are provided in the hangar 1, one on either side of the door member 11. The support members 14, 14' extend rearwardly and generally perpendicularly from the door member 11. The two quadrant members 16, 16' are attached to the door member 11, one on either side of the upper door portion 12, and extend rearwardly therefrom. The quadrant members 16, 16' are supported by the support members 14, 14' respectively. Thus the weight of the door member 11 is also supported by the support members 14, 14'. The quadrant members 16, 16' are adapted to roll along the support members 14, 14' to tilt the door member 11 between a generally vertical closed position (FIGS. 1*a* and 2*a*) and a generally horizontal open position (FIGS. 1*d* and 2*d*). A drive means 18 (FIGS. 3–6) is connected to the door and quadrant assembly B for tilting the door member 11 between the open and closed positions. The drive means 18 is preferably connected to at least one of the quadrant members 16 or 16'. The drive means 18 further locks the door member 11 against tilting movement unless driven by the drive means 18. Anti-skid means 19 (FIGS. 4 and 5) are provided between each of the quadrant members 16, 16' and the support members 14, 14' to force the quadrant members 16, 16' to roll, and not skid, along the support members 14, 14' as the door member 11 is being tilted.

The Door Member

The structural details of the door member 11 are shown in Figures 3–7. The upper door portion 12 is preferably reinforced to provide transverse rigidity to the door member 11. With a large door span, the weight of the door member, together with such forces as the wind acting against the door member 11, can bow the door member 11 unless it is reinforced. To that end, a space frame 20 is provided in the upper door portion 12 thereby increasing the thickness of at least a portion of the upper door portion 12. The space frame 20 consists of parallel spaced upper and lower horizontal trusses 21, 22 interconnected by a plurality of parallel spaced vertical trusses 23. As mentioned above, the upper door portion 12 is connected on either side to the quadrant members 16, 16'. To transfer the weight of the door member 11, the space frame 20 is reinforced on either side by vertical side frame members 24, 24'. Each of these side frame members 24, 24' is connected to the quadrant member 16 or 16' through a pair of connecting brackets 26 or 26'.

The upper door portion 12 and more particularly the space frame 20, is sized to give the door member 11 its necessary transverse rigidity while still perm1tting the upper door portion 12 to clear the header 5 as the door member 11 is being tilted. By this is meant, in the present embodiment, that the trusses 21, 22 and 23 are so spaced and sized that they reinforce the door member 11 while not colliding with the header 5 as the door member 11 is tilted. In the door open position, the space frame 20 is tucked beneath the roof 6, in the header space 7, and the lower door portion 13 extends beneath the header 7 into the front opening 2 by a distance equal to the thickness of the lower door portion 13. For this reason, the thickness of the lower door portion 13 is reduced relative to that of the upper door portion 12, to maximize the height of the front opening 2 available in this door open position.

In the embodiment shown in FIG. 1, the lower door portion 13 is recessed relative to the outer plane of the upper door portion 12. Alternatively, the lower door portion 13 may be tapered from the increased thickness of the upper door portion 12 to the decreased thickness of the lower door portion, as shown schematically in FIG. 2. The latter embodiment may increase the thickness of the lower door portion 13 relative to that of the first embodiment, and therefore might be used in situations in which the opening height need not be maximized relative to the building height.

The upper door portion 12 also includes a plurality of upwardly and rearwardly extending trusses 28 connected above the space frame 20 and abutting against the header 5. These trusses 28 serve to seal the door member 11 against the header 5 in the door closed position.

The space frame 20, lower door portion 12 and upper trusses 28 are all covered with cladding 29. Sheet metal is suitable for this purpose.

To seal the door member 11 in the opening 2, a plurality of U-shaped flexible seals 30 are provided around the perimeter of the door member 11.

Figure 6:
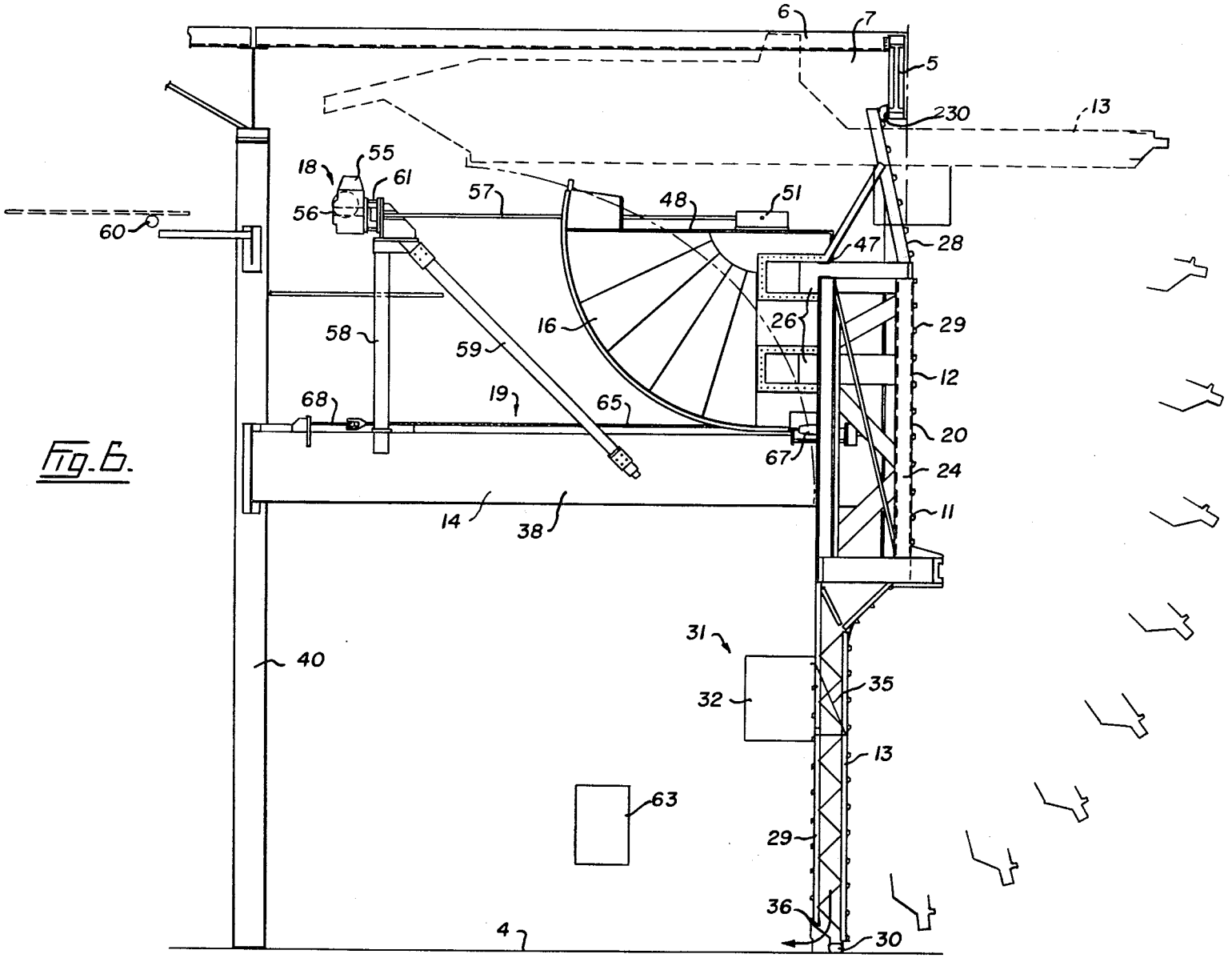
FIG. 6 is a side view of the door assembly, the door member being shown in section.
Figure 7:
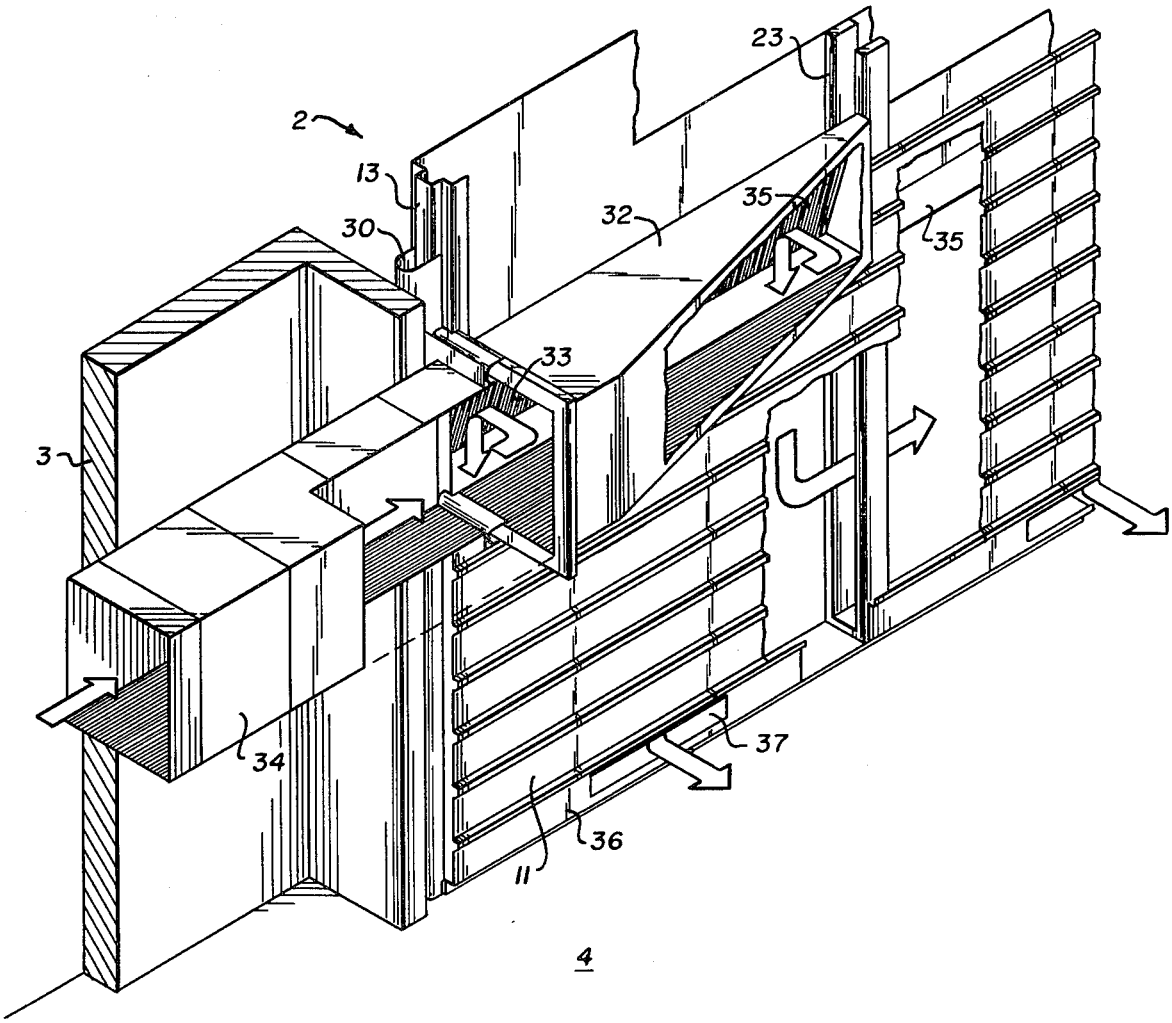
FIG. 7 is a fragmentary side perspective view of the door member, showing the preferred heating means.

As shown in FIGS. 6 and 7 , the door assembly A preferably includes heating means 31 which, in the door closed position, direct warm air downwardly through the lower door portion 13 and into the hangar 1. This flow of warm air is shown by the arrow in-the Figures. In cold climates this warm air flow will rapidly heat the front of the hangar 1 after the door member is closed. The heating means 31 includes a transition duct 32 attached to the lower door portion 13, and having an open end 33 which aligns with a stationary heating duct 34 at the front of the hangar 1 in the door closed position. A transverse baffle 35 is provided in the transition duct 32 to direct the air downwardly therethrough. The bottom edge 36 of the lower door portion 13 is provided with transversely spaced openings 37 equipped with registers (not shown) to direct the air flow.

The Support Members

The support members 14, 14' firstly provide the support for the quadrant members 16, 16' and the door member 11, and secondly, provide a track on which the quadrant members 16, 16' roll. The support members 14, 14' include horizontal I-beams 38, 38' extending rearwardly and generally perpendicularly from the door member 11. Opposite ends of the I-beams 38, 38' are supported by the front walls 3, 3' of the hangar 1 and vertical beams 40, 40' extending between the hangar roof 6 and the hangar floor 4. Thus the weight of the quadrant members 16, 16' and the door members 11 is actually transferred through the I-beams 38, 38' to the hangar structure.

The I-beams 38, 38' preferably include guide ridges 43, 43' along their length to guide the quadrant members 16, 16' therealong in a manner to be later described.

The support members 14, 14' are most preferably located on either side of the door member 11, behind the front walls 3, 3' to thereby maximize the useable width of the opening 2.

The Quadrant Members

The quadrant members 16, 16' each include an arced edge 45, 45' between two angularly spaced radial arms 47, 48 and 47', 48' respectively. The arms 47, 48 and 47', 48' are angularly disposed preferably at 90° apices 51, 51'. The arced surfaces 45, 45' preferably each follow the arc of a quarter circle.

Each of the arms 47, 47' is connected to an upper corner of the door member 11 through the connecting brackets 26, 26'. More preferably, the radial arms 47 and 47' are connected to the sides of the vertical side frame members 24, 24' to so space the quadrant members 16, 16' clear of the opening 2.

Each of the quadrant members 16, 16' is supported along the arced edges 45, 45' by the I-beams 38, 38'. From the above-described preferred construction of the quadrant members 16, 16', it will be apparent that rotation of the quadrant members 16, 16' along the support members 14, 14' will cause the door member 11 to tilt upwardly and rearwardly through 90° from a generally vertical door closed position to a generally horizontal door open position.

The arced edges 45, 45' preferably include guide grooves 52, 52' adapted to receive the ridges 43, 43' of the support members 14, 14' to guide the quadrant members 16, 16' therealong.

The Drive Means

The drive means 18 are preferably provided in duplicate, one connected to each of the quadrant members 16, 16'. The drive means 18 preferably include motors 55, 55' supported on the support members 14, 14' rearwardly of the quadrant members 16, 16'. The motors 55, 55' include internally threaded nut members 56, 56' rotatably driven by the motors through the gear boxes 54, 54'.

The drive means 18 further includes threaded rods 57, 57' arranged parallel to the support members 14, 14'. One end of each of the rods 57, 57' is pivotally connected to the apex 51 or 51' of the quadrant member 16 or 16', the other end being threaded through the nut members in the motors 55, 55'.

The motors 55, 55' are supported above the support members 14, 14' by vertical support members 58, 58' and angle braces 59, 59'. The height of the motors 55, 55' above the support members 14, 14' is adjusted such that the threaded rods 57, 57', connected therethrough, are aligned parallel with the support members 14, 14'.

The threads on the nut members 56, 56' and the rods 57, 57' are self-locking, that is the pitch of the threads is such that the rods cannot move through the nut members unless the nut members are rotated. This provision effectively locks the threaded rods 57, 57' against movement through the nut members 56, 56' unless the nut members are being rotatably driven. Thus the door member 11 is locked against tilting movement unless being tilted by the drive means 18. This provision obviates the need for a counterweight on the quadrant members 16, 16', since the drive means 18 positively counterbalances the weight of the door member 11 and quadrant members 16, 16'. Furthermore, the drive means 18 can positively counterbalance against the unpredictable wind force acting on the door member 11.

As shown in FIG. 6, the drive means 18 further preferably comprises roller members 60, 60' supported rearwardly of the motors 55, 55' by the vertical beaas 40,40'. These roller members 60, 60' support the threaded rods 57, 57' in the door open positions, as illustrated by the dotted lines in FIG. 6.

The motors 55, 55' are synchronized to roll the quadrant members 16, 16' at approximately the same speeds to prevent any twisting action on the door member 11. More preferably, an electrical timing device (not shown) is provided on each motor 55, 55' which causes the leading motor to pause several times during the opening movement and allow the other motor to catch up.

The drive means 18 also preferably includes conventional first universal joints 61, 61' interconnecting the support members 58, 58' and the gearboxes 54, 54'. Second universal joints 62, 62' are also provided interconnecting the threaded rods 57, 57' and the apices 51, 51' of the quadrant members 16, 16'. These joints allow some universal movement of the threaded rods 57, 57' to correct for imperfect alignments in the door assembly A.

The drive means 18 are preferably controlled from a control panel 63 conveniently located in the hangar 1.

The Anti-Skid Means

The anti-skid means 19 are provided between each of the quadrant members 16, 16' and the support members 14, 14' to force the quadrant members to roll along the support members. Preferably these means 19 include first pairs of cables 64, 64' and second pairs of cables 65, 65' stretched along the arced edges 45, 45' respectively. The first cables 64, 64' are connected at one end to the support members 14, 14' at approximately the point of contact between the quadrant members 16, 16' and the support members 14, 14' in the door closed position, and at their other end to the quadrant members 16, 16' at approximately the point of contact between the quadrant members 16, 16' and the support members 14, 14' in the door open position. This arrangement ensures that the cables 64, 64' extend along the entire circumference of the arced edge 45, 45' which actually rolls along the support members 14, 14' hereinafter referred to as the "contacting circumference". Thus, as the door member 11 is being opened, the first cables 64, 64' are pulled taut to force the quadrant members 16, 16' to roll. Of course the length of the cables 64, 64' may be slightly shorter or considerably longer than the contacting circumference of the arced edges 45, 45', and still permit the cables 64, 64' to prevent skidding. Accordingly, the phrase "approximately at the point of contact" has been used to describe the connection between the cables 64, 64' and the quadrant members 16, 16' or support members 14, 14'.

The second pairs of cables 65, 65' are connected at one end to the quadrant members 16, 16' at approximately the point of contact between the quadrant members 16, 16' and the support members 14, 14' in the door closed position, and at their other end to the support members 14, 14' at approximately the point of contact between the quadrant members 16, 16' and the support members 14, 14' in the door open position. Here again, this arrangement ensures that the cables 65, 65' extend along the entire contacting circumference of the arced edges 45, 45'. As the door is being closed, the second cables 65, 65' are pulled taut to force the quadrant members 16, 16' to roll. As with the first cables 64, 64', the length of the second cables 65, 65' may vary slightly.

The anti-skid means 19 also preferably include a plurality of guide dogs 66 on both the arced surfaces 45, 45' and the support members 14, 14', on either side of the cables 64, 64' and 65, 65' to thereby align the cables and prevent the cables from being pinched under the weight of the door member 11 and the quadrant members 16, 16'.

The anti-skid means 19 also preferably include first pivotal connections 67, 67',to connect the first cables 64, 64' to the support members 14, 14', and pivotal connections 68, 68' to connect the second cables 65, 65' to the support members 14, 14'. These pivotal connections permit the load to be evenly distributed between the two cables of each cable pair.

An alternative form of anti-skid means would comprise a rack and teeth system between the quadrant members 16, 16' and the support members.

While the present invention has been disclosed in connection with the preferred embodiment thereof, it will be understood that there may be other embodiments which fall within the spirit and scope of the invention as defined by the following claims.

The embodiments of the invention in which an exclusive property or privilege is claimed are defined as follows:

1. An overhead tilting door assembly provided in a building having an opening closed by the door member, and a header extending downwardly a small distance into the opening comprising:

a non-counterweighted door and quadrant assembly including a door member and a pair of quadrant members, each of the quadrant members being connected to and extending rearwardly from the upper corner of the door member, and each quadrant member having an arced edge, the door member comprising adjoining upper and lower door portions, the upper portion having an increased thickness, substantially across its width, relative to that of the lower portion for providing transverse rigidity to the door member, the upper portion being sized to clear the header as the door member is tilted between open and closed positions, whereby, in the open position, the lower door portion, of decreased thickness, extends below the header;

a pair of generally horizontal fixed support members, one on either side of the door member, extending generally rearwardly from the door member, each of the quadrant members being supported along the arced edge by the support member such that the quadrant members can roll along the support members to tilt the door member between a generally vertical closed position and a generally horizontal open position;

drive means connected to at least one of the quadrant members for tilting the door member and for locking the door member against tilting movement unless being tilted by the drive means, said drive means providing all of the force required to tilt said door member;

anti-skid means, located between the arced edges of the quadrant members and the support members and interconnecting the fixed support members and the movable quadrant members, said anti-skid means being operative to force the quadrant members to roll along the support members as the door is being tilted;

each quadrant member including a pair of angularly disposed radii bounding the arced edges, the radii meeting at an apex opposite the arced edge; and wherein the drive means comprises an internally-threaded, rotatably driven nut member supported rearwardly from the quadrant member;

a threaded rod arranged parallel to the support member, one end of the rod being pivotally connected to the apex of the quadrant member, the other end of the rod being threadably received in the nut member, the threads of the rod and the nut member being self-locking such that the threaded rod is locked against movement through the nut member unless the nut member is being rotatably driven, whereby rotation of the nut member moves the rod through the nut member causing the quadrant member to roll along the support member to tilt the door member.

2. The door assembly as set forth in claim 1, wherein: the drive means further includes a universal joint at each end of the threaded rods.

3. The door assembly as set forth in claim 1 wherein the anti-skid means each comprise:

a first cable stretched along the arced edge, one end of which is connected to the member approximately at the point of contact between the member and the support member in the door closed position, the opposite end of which is connected to the quadrant member approximately at the point of contact between the quadrant member and the support member in the door open position; and a second cable stretched along the arced edge, one end of which is connected to the quadrant approximately at the point of contact between the quadrant member and the support member in the door closed position the opposite end of which is connected to the support member approximately at the point of contact between the quadrant member and the support member in the door open position.

4. An overhead tilting door assembly comprising:

a non-counterweighted door and quadrant assembly including a door member and a pair of quadrant members, each of the quadrant members being connected to and extending rearwardly from an upper corner of the door member, and each quadrant member having an arced edge;

a pair of generally horizontal fixed support members, one on either side of the door member, extending generally rearwardly from the door member, each of the quadrant members being supported along the arced edge by the support member such that the quadrant members can roll along the support members to tilt the door member between a generally vertical closed position and a generally horizontal open position;

drive means connected to the door and quadrant assembly for tilting the door member and for locking the door member against tilting movement unless being tilted by the drive means, said drive means providing all of the force required to tilt said door member;

anti-skid means, located between the arced edges of the quadrant members and the support members and interconnecting the fixed support members and the moveable quadrant members, said anti-skid means being operative to force the quadrant members to roll along the support members as the door is being tilted;

the anti-skid means each comprising a first cable, stretched along the arced edge, one end of which is connected to the support member approximately at the point of contact between the quadrant member and the support member in the door closed position, the opposite end of which is connected to the quadrant member approximately at the point of contact between the quadrant member and the support member in the door open position; and a second cable stretched along the arced edge, one end of which is connected to the quadrant approximately at the point of contact between the quadrant member and the support member in the door closed position the opposite end of which is connected to the support member approximately at the point of contact between the quadrant member and the support member in the door open position.

5. An overhead tilting door assembly providing in a building having an opening closed by the door member, and a header extending downwardly a small distance into the opening comprising:

a non-counterweighted door and quadrant assembly including a door member and a pair of quadrant members, each of the quadrant members being connected to and extending rearwardly from the upper corner of the door member, and each quadrant member having an arced edge, the door member comprising adjoining upper and lower door portions, the upper portion having an increased thickness, substantially across its width, relative to that of the lower portion, for providing transverse rigidity to the door member, the upper portion being sized to clear the header as the door member is tilted between open and closed positions, whereby, in the open position, the lower door portion, of decreased thickness, extends below the header;

a pair of generally horizontal fixed support members, one on either side of the door member, extending generally rearwardly from the door member, each of the quadrant members being supported along the arced edge by the support member such that the quadrant members can roll along the support members to tilt the door member between a generally vertical closed position and a generally horizontal open position;

drive means connected to the door and quadrant assembly for tilting the door member and for locking the door member against tilting movement unless being tilted by the drive means, said drive means providing all of the force required to tilt said door member;

anti-skid means, located between the arced edges of the quadrant members and the support members and interconnecting the fixed support members and the movable quadrant members, said anti-skid means being operative to force the quadrant members to roll along the support members as the door is being tilted;

the anti-skid means each comprising a first cable, stretched along the arced edge, one end of which is connected to the support member approximately at the point of contact between the quadrant member and the support member in the door closed position, the opposite end of which is connected to the quadrant member approximately at the point of contact between the quadrant member and the support member in the door open position; and a second cable stretched along the arced edge, one end of which is connected to the quadrant approximately at the point of contact between the quadrant member and the support member in the door closed position the opposite end of which is connected to the support member approximately at the point of contact between the quadrant member and the support member in the door open position.

* * * * *